US006302457B1

(12) United States Patent
Shen

(10) Patent No.: US 6,302,457 B1
(45) Date of Patent: Oct. 16, 2001

(54) EASY-TO-INSTALL DOOR LOCK WITH IMPROVED ANTI-TORQUE EFFECT FOR OUTSIDE ROSE ASSEMBLY

(76) Inventor: Mu-Lin Shen, No. 32, Lane 76, Fu-An Road, Sec. 5, Tainan (TW)

( * ) Notice: Subject to any disclaimer, the term of this patent is extended or adjusted under 35 U.S.C. 154(b) by 0 days.

(21) Appl. No.: 09/576,332

(22) Filed: May 22, 2000

(51) Int. Cl.[7] ..... E05B 15/02
(52) U.S. Cl. ..... 292/357; 292/336.3; 292/347
(58) Field of Search ..... 292/169.23, 173, 292/347, 336.3, 357

(56) References Cited

U.S. PATENT DOCUMENTS 3,985,008 * 10/1976 Hart ..... 292/357
5,265,924 * 11/1993 Kim ..... 292/336.3
5,617,749 * 4/1997 Park ..... 292/336.3

* cited by examiner

*Primary Examiner*—Stephen Avila
(74) *Attorney, Agent, or Firm*—Alan Kamrath; Rider, Bennett, Egan & Arundel, LLP

(57) ABSTRACT

A door lock includes a main body including a transmission assembly and a positioning assembly. The positioning assembly includes an inside seat and an outside seat. An inside rose liner is mounted around the inside seat and includes two positioning holes. An inside rose is mounted around the inside rose liner. An anti-torque ring is mounted around the outside seat and includes two lugs formed thereon. Two positioning posts respectively project from the lugs and extend along a longitudinal direction of the anti-torque ring. An outside rose liner includes an inner threading that is engaged with an outer threading of the outside seat. The outside rose liner includes a side with an annular recessed portion for receiving the anti-torque ring. The annular recessed portion includes two recess extensions for positioning the lugs of the anti-torque ring. An outside rose is securely mounted around the outside rose liner to rotate move therewith. Rotation of the outside rose causes longitudinal movement of the outside rose and the outside rose liner relative to the outside seat to suit different door thickness.

6 Claims, 6 Drawing Sheets

EASY-TO-INSTALL DOOR LOCK WITH IMPROVED ANTI-TORQUE EFFECT FOR OUTSIDE ROSE ASSEMBLY

BACKGROUND OF THE INVENTION

1. Field of the Invention

The present invention relates to a door lock that can be installed easily. The present invention also relates to a door lock for preventing loosening of the rose assembly from the lock chassis when a torque is applied the outside rose assembly.

2. Description of the Related Art

U.S. Pat. No. 4,921,289 to Shen issued on May 1, 1990 discloses a cylindrical lever type lock structure for handicapped people. It is found that the lock structure is not strong enough to resist intentional destruction by means of forcibly pulling the outside handle away from the door. U.S. Pat. No. 5,265,924 to Kim issued on Nov. 30, 1993 discloses a lever assembly for a door lock. Nevertheless, the rose assembly must be removed for adjustment in response to different thickness of the door to which the door lock is mounted. After the door lock is mounted to a door, the outside rose assembly should not be loosened when a torque is applied to the outside rose. Yet, the outside rose assembly still tends to be loosened as a result of door slam or applying a larger torque to the outside rose.

The present invention is intended to provide an improved door lock that mitigates and/or obviate the above problems.

SUMMARY OF THE INVENTION

It is an object of the present invention to provide a door lock that can be installed easily.

It is another object of the present invention to provide a door lock for preventing damage as a result of applying torque to the outside rose assembly.

It is a further object of the present invention to provide a door lock for preventing loosening of the outside rose assembly in case of door slam or applying a larger torque to the outside rose.

A door lock in accordance with the present invention comprises:

a main body including a transmission assembly and a positioning assembly, the transmission assembly including an inside spindle, an outside spindle, a retractor, and a latch bolt, the positioning assembly including an inside seat and an outside seat, the outside seat including an outer threading;

an inside rose liner mounted around the inside seat;

an inside rose mounted around the inside rose liner;

an anti-torque ring mounted around the outside seat and including two lugs formed thereon, two positioning posts respectively projecting from the lugs and extending along a longitudinal direction of the anti-torque ring;

an outside rose liner including an inner threading that is engaged with the outer threading of the outside seat, the outside rose liner including a side with an annular recessed portion for receiving the anti-torque ring, the annular recessed portion including two recess extensions for positioning the lugs of the anti-torque ring, thereby preventing loosening of the outside rose liner;

an outside rose securely mounted around the outside rose liner to rotate move therewith;

an inside handle operably connected to the transmission assembly; and an outside handle operably connected to the transmission assembly;

whereby rotation of the outside rose causes longitudinal movement of the outside rose and the outside rose liner relative to the outside seat to suit a thickness of a door to which the door lock is mounted.

The inside seat includes an outer threading having two diametrically disposed flat surfaces. The inside rose liner includes a hole. An inner periphery that defines the hole of the inside rose liner includes two diametrically disposed flat sections. The inside rose liner is mounted around the inside seat with the flat sections of the inside rose liner engaged with the flat surfaces of the inside seat.

A pull-resisting ring is mounted around the inside seat. The pull-resisting ring includes an inner threading engaged with the outer threading of the inside seat. The inside rose liner includes two diametrically disposed protrusions, and wherein the pull-resisting ring includes a plurality of annularly spaced depressions for releasably receiving the protrusions, thereby retaining the pull-resisting ring.

The outside seat includes an outer threading having two diametrically disposed flat surfaces. The anti-torque ring including a hole. An inner periphery that defines the hole of the anti-torque ring includes two diametrically disposed flat sections. The anti-torque ring is mounted around the outside seat with the flat sections of the anti-torque ring engaged with the flat surfaces of the outside seat.

The inside rose liner includes two positioning holes. Each positioning post includes a screw hole aligned with an associated positioning hole. Two screws are provided and each is extended through the associated positioning hole and the screw hole in an associated positioning post.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
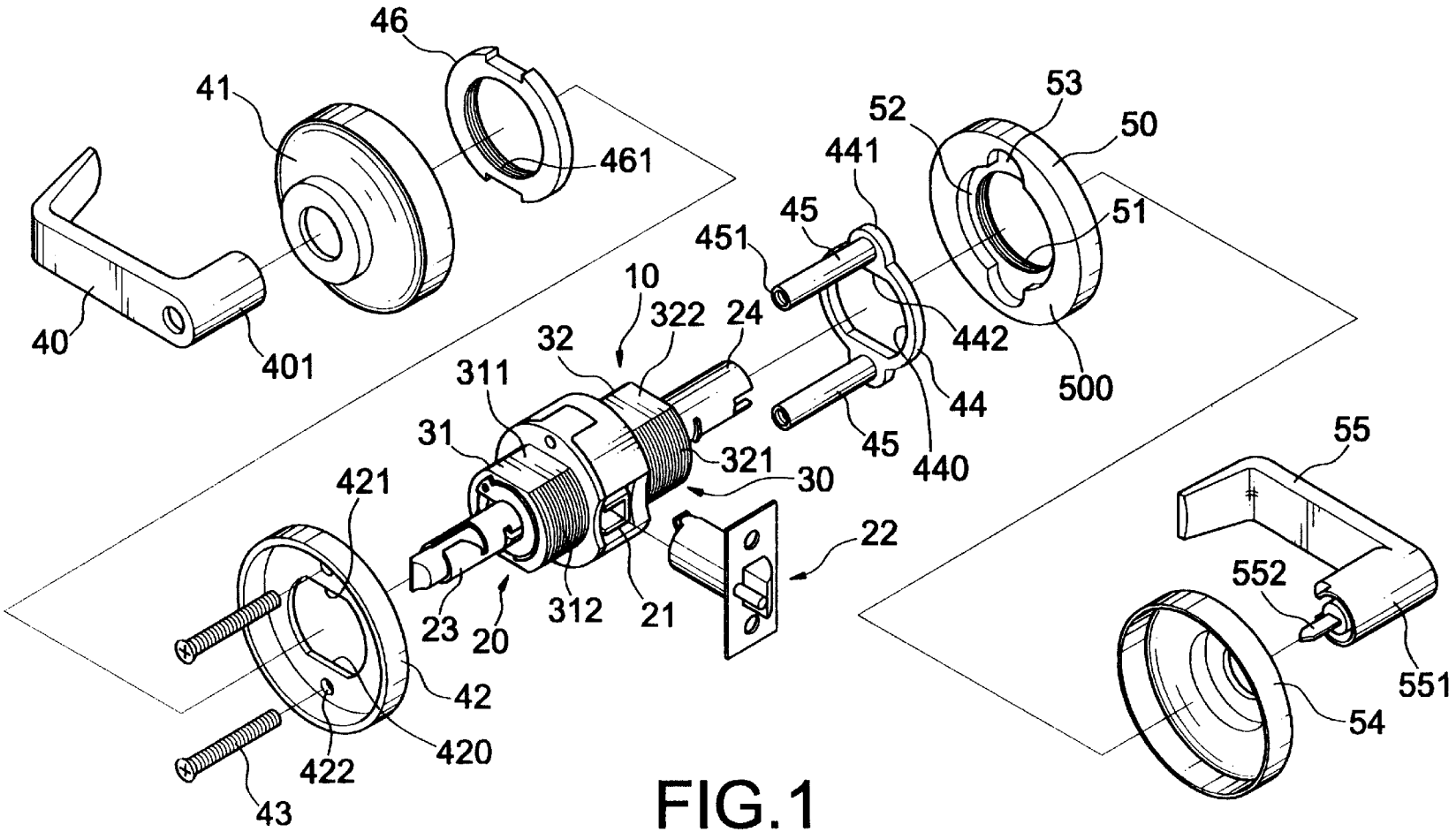
FIG. 1 an exploded perspective view of a door lock in accordance with the present invention.
Figure 2:
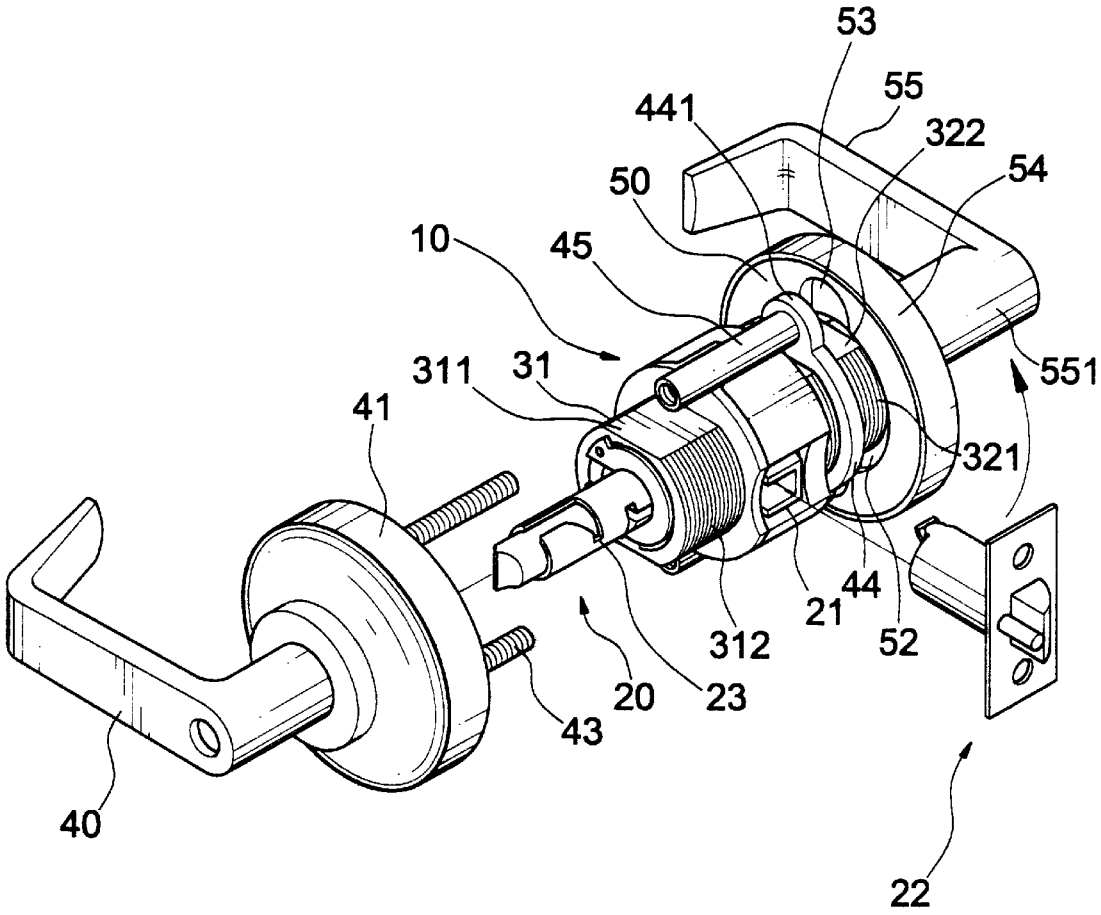
FIG. 2 is an exploded perspective view of the door lock in accordance with the present invention, wherein most of the parts of the door lock have been assembled.

Referring to FIGS. 1 and 2, a door lock in accordance with the present invention generally includes a main body 10, an inside rose liner 42, an outside rose liner 50, an anti-torque ring 44, an inside rose 41, a pull-resisting ring 46, an outside rose 54, an inner handle 40 (e.g., a lever handle), and an outside handle 55 (e.g., a lever handle). The main body 10 includes a transmission assembly 20 and a positioning assembly 30. The transmission assembly 20 includes an inside spindle 23, an outside spindle 23, a retractor 21, and a latch bolt 22. The positioning assembly 30 includes an inside seat 31 and an outside seat 32. The inside seat 31 includes an outer threading 312 having two diametrically disposed flat surfaces 311. The outside seat 32 includes an outer threading 321 having diametrically disposed flat surfaces 322.

The inside rose liner 42 includes two diametrically disposed flat sections 421 in an inner periphery defining a hole 420 thereof. The inside rose liner 42 further includes two diametrically arranged positioning holes 422 through which screws 43 are extended. The inside rose liner 42 is mounted around the inside seat 31 with the flat sections 421 of the inside rose liner 42 being in contact with the flat surfaces 311 of the inside seat 31.

The anti-torque ring 44 includes two diametrically disposed flat sections 442 in an inner periphery defining a hole 440 thereof. Two lugs 441 are formed on the anti-torque ring 44 and two positioning posts 45 respectively project from the lugs 441 and extend along a longitudinal direction of the anti-torque ring 44. The anti-torque ring 44 is mounted around the outside seat 32 with the flat sections 442 being in contact with the flat surfaces 322 of the outside seat 32. In addition, a screw hole 451 in each positioning post 45 is aligned with an associated positioning hole 422 in the inside rose liner 42. Screws 43 are extended through the positioning holes 422 of the inside rose liner 42 and the screw holes 451 in the positioning posts 45. The pull-resisting ring 46 includes an inner threading 461 so as to be engaged with the outer threading 312 of the inside seat 31.

The outside rose liner 50 includes an inner threading 51 so as to be engaged with the outer threading 321 of the outside seat 50. Formed on a side 500 of the outside rose liner 50 that abuts against the outside seat 32 is an annular recessed portion 52 for receiving the antitorque ring 44. The annular recessed portion 52 includes two recess extensions 53 which are preferably diametrically arranged. The recess extensions 53 are provided to receive the lugs 441 of the anti-torque ring 44. The outside rose liner 50 is securely mounted inside the outside rose 54 to move therewith.

The outside handle 55 includes an end 551 that is extended through the outside rose 54. A lock core 552 is mounted in the end 551 of the outside handle 55 and extended into the outside spindle 24. The inside handle 40 includes an end 401 that is extended through the inside rose 41. When either spindle 40 or 55 is turned, the retractor 21 is moved inward to retract the latch bolt 22 away from an opening (not shown) defined in a door frame (not shown), which is conventional and therefor not further described.

Figure 3:
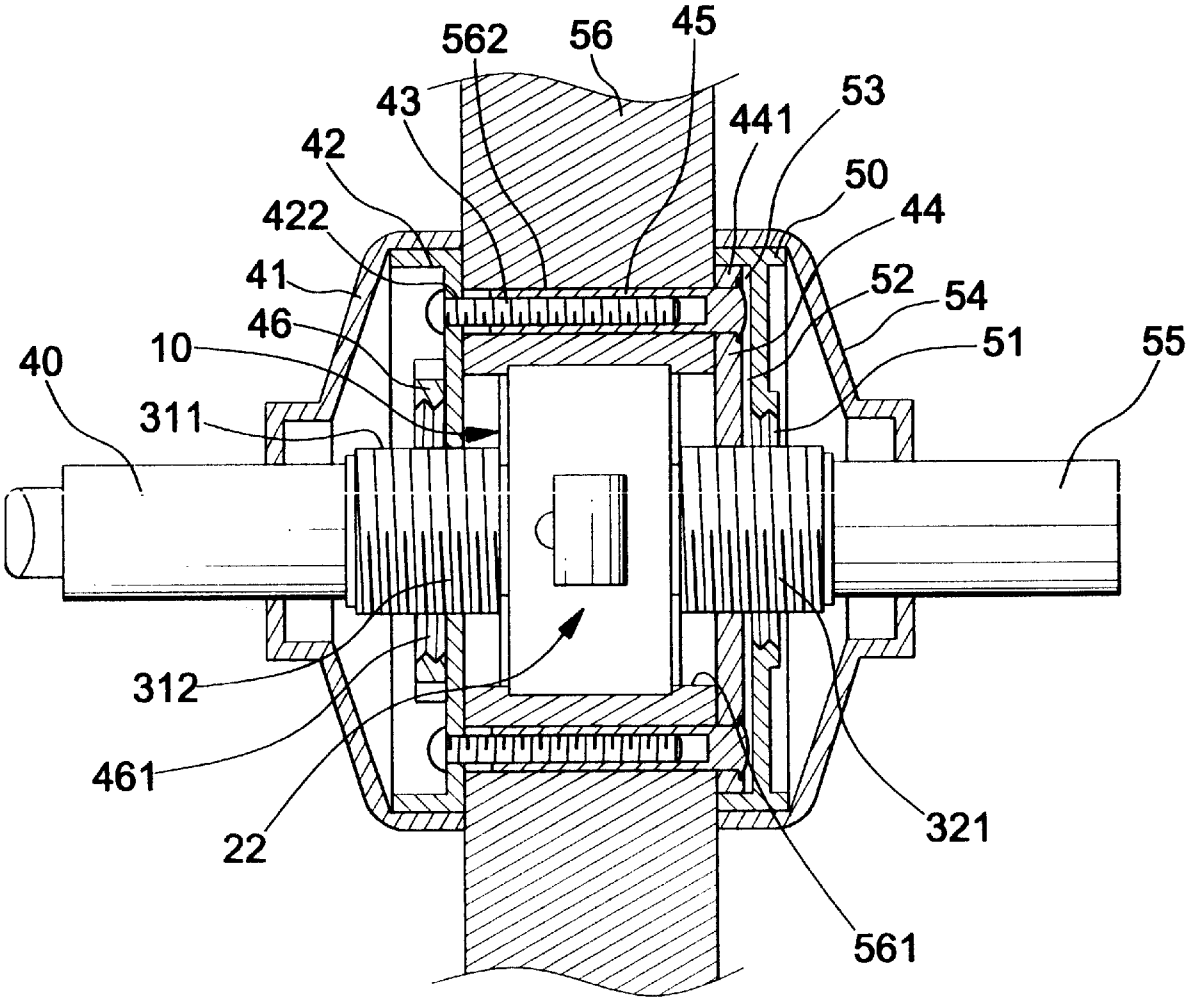
FIG. 3 is a sectional view of the door lock in accordance with the present invention mounted to a thin door.

Referring to FIGS. 1 and 3, when mounting the door lock of the present invention to a thin door 56, the anti-torque ring 44 is moved away from the outside rose liner 50 such that the lugs 441 of the anti-torque ring 44 are disengaged from the recess extensions 53 of the outside rose liner 50. When the outside rose 54 is turned, and the outside rose liner 50 securely mounted in the outside rose 54 is also turned. By means of turning the outside rose 54, the outside rose liner 50 and the outside rose 54 move longitudinally relative to the outside seat 32 due to threading engagement 321 and 51. Thus, position of the outside rose liner 50 and the outside rose 54 can be adjusted to suit the thickness of the door 56. The main body 10 is inserted into a hole 561 in the door 56. The positioning posts 45 of the anti-torque ring 44 are extended through positioning holes 562 in the door 56. An outer side of the anti-torque ring 44 bears against a bottom wall (not labeled) defining the annular recessed portion 52 with the lugs 441 positioned in the recess extensions 53, respectively. The retractor 21 is located in a center of the door thickness and thus faces the opening in the door frame. The inner rose liner 42 is then mounted to the inside seat 31 and the screws 43 are extended through the holes 422 in the inside rose liner 42 and the screw holes 451 in the positioning posts 45. Next, the pull-resisting ring 46 is mounted to the inside seat 31, and the inside rose 41 and the inside handle 40 are mounted to finish the assembly procedure. It is appreciated that the outside rose assembly (including the outside rose 54 and the outside rose liner 50) has increased anti-torque effect, as the outside rose 54 and the outside rose liner 50 are secured together and the anti-torque ring 44 is positioned in the annular recessed portion 52 of the outside rose liner 50.

Figure 4:
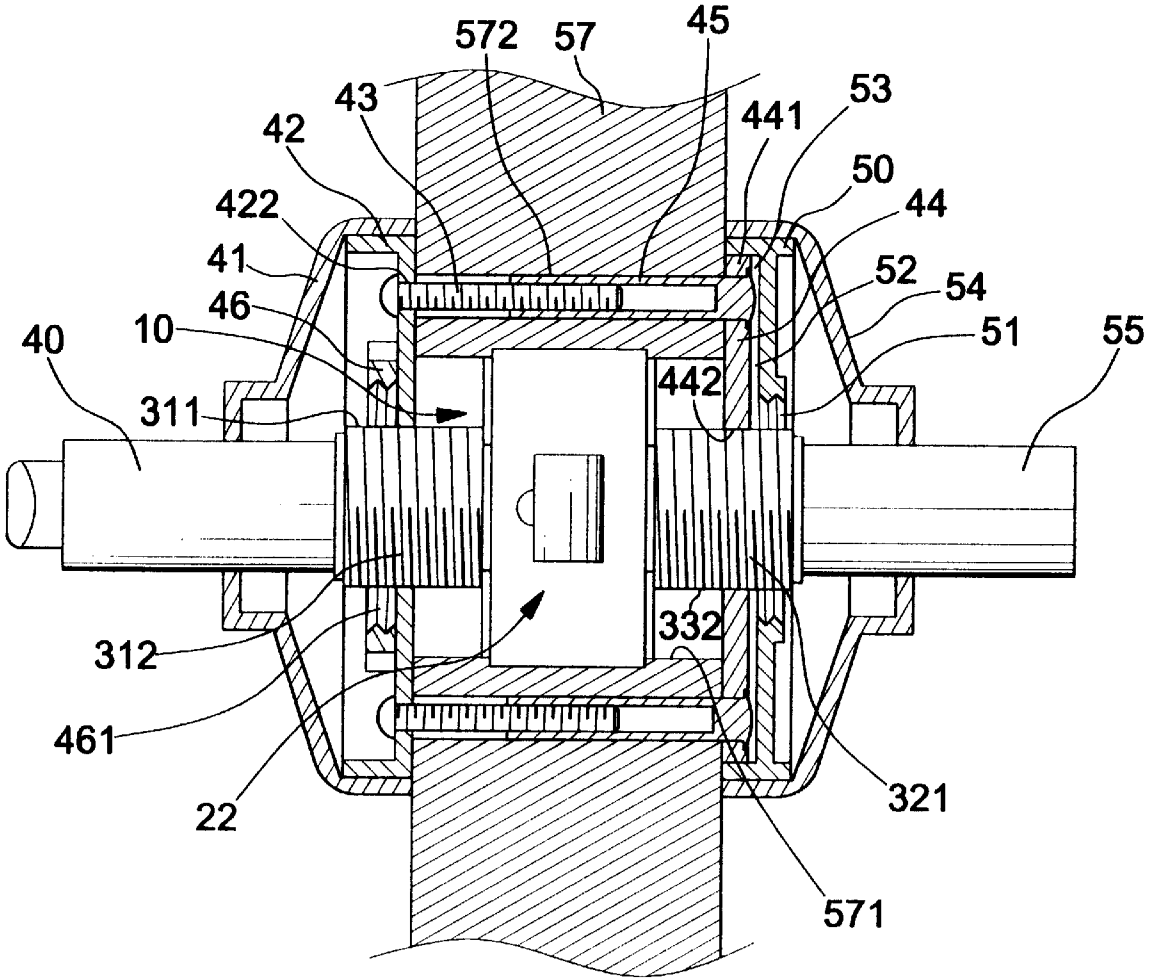
FIG. 4 is a sectional view similar to FIG. 3, wherein the door lock is mounted to a thick door.

FIG. 4 shows mounting of the door lock of the present invention to a thick door 57. The installation procedure is identical to that for a thin door 56. Thus, when mounting the door lock to a door, the locksmith or the user may simply rotate the outside rose 54 to adjust the position of the outside rose 54 and the outside rose liner 50 to suit the door thickness. The outside rose 54 and the outside handle 55 need not to be detached, which is quite convenient.

As illustrated in FIGS. 3 and 4, the lugs 441 of the anti-torque ring 44 are positioned in the recess extensions 53 of the outside rose liner 50. Namely, the anti-torque ring 44 is completely covered by the outside rose liner 50. In addition, the flat sections 442 of the anti-torque ring 44 are engaged with the flat surfaces 322 of the outside seat, and the flat sections 421 of the inside rose liner 42 are engaged with the flat surfaces 311 of the inside seat 31. All of these provide increased torque-bearing capacity, thereby lengthening longevity of the door lock.

Further, inner threading 461 of the pull-resisting ring 46 is engaged with outer threading 312 of the inside seat 31, and the pull-resisting ring 46 bears against a side of the inner rose liner 42. This increases strength of the door lock to prevent intentional destruction by means of forcibly pulling the outside handle away from the door. The outside rose assembly (including the outside rose 54 and the outside rose liner 50) has increased anti-torque effect, as the outside rose 54 and the outside rose liner 50 are secured together and the anti-torque ring 44 is positioned in the annular recessed portion 52 of the outside rose liner 50. It is noted that the overall structure of the door lock in accordance with the present invention is simple, yet the outside rose assembly is strong enough to resist torque, thereby preventing damage resulting from forcibly turning either handle 40, 55. Further, the rose liners in conventional door locks tend to become loosened after a term of usage or due to door slam. Such a drawback is avoided by means of provision of the inside rose liner 42 and the outside rose liner 50 under cooperation of the anti-torque ring 44 that is positioned in the annular recessed portion 52 of the outside rose liner 50.

Figure 5:
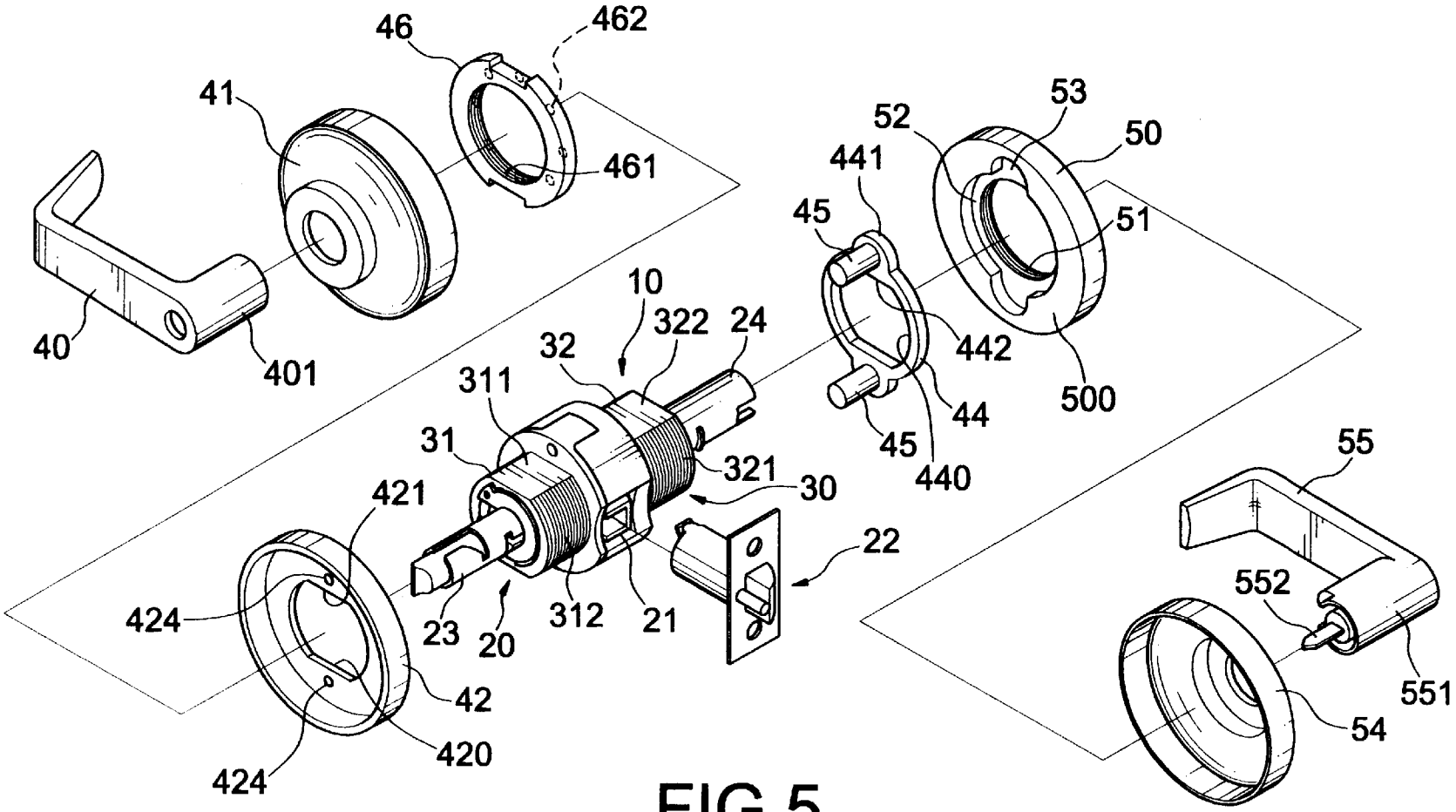
FIG. 5 is an exploded perspective view of a modified embodiment of the door lock in accordance with the present invention, wherein most of the parts of the door lock have been assembled.
Figure 6:
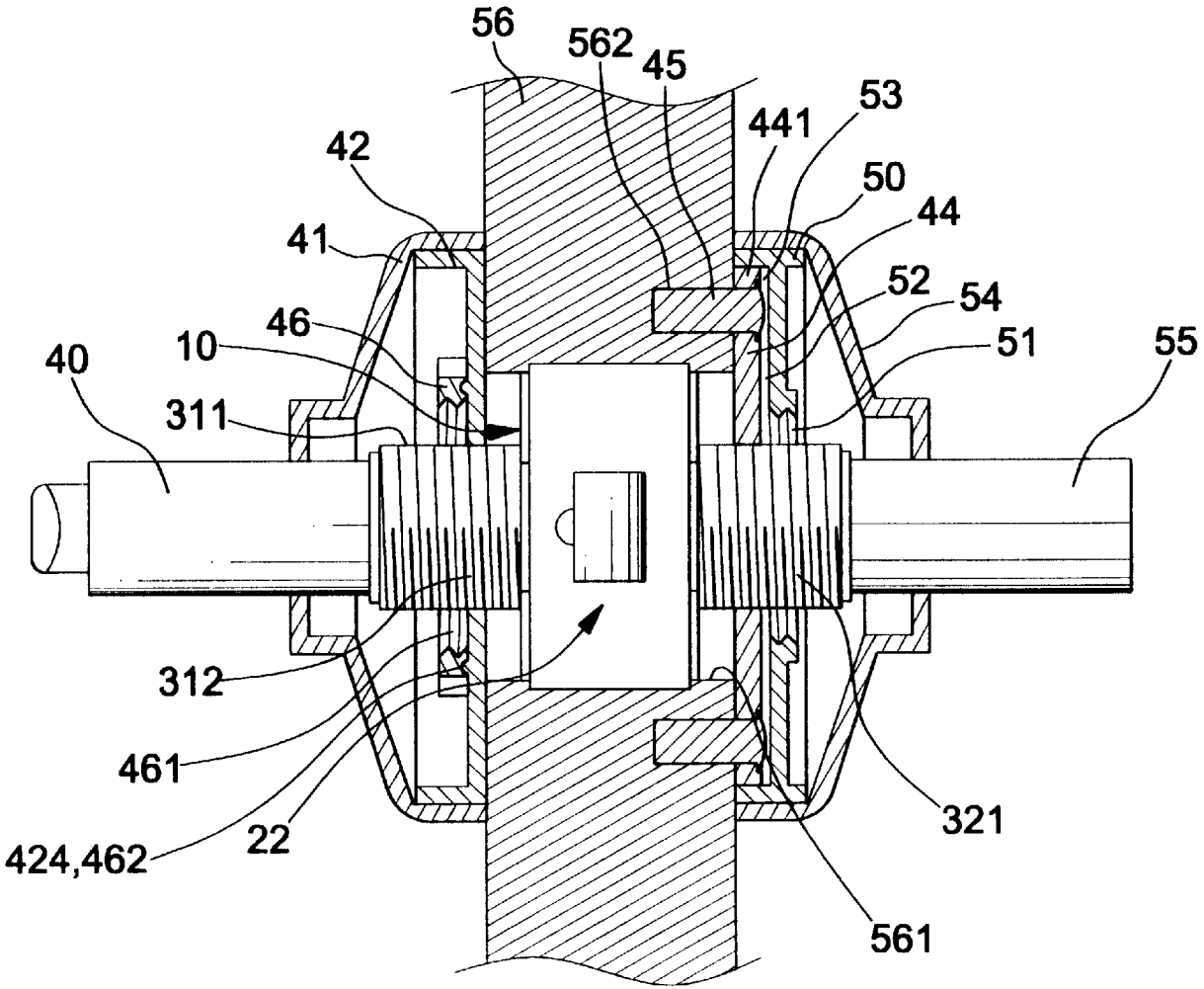
FIG. 6 is a view of the door lock in FIG. 2 mounted to a door.

FIGS. 5 and 6 illustrate a modified embodiment of the invention, wherein the positioning posts 45 in the modified embodiment have no screw holes and are shorter, and the positioning hole 562 in the door 56 has an appropriate length for receiving the positioning posts 45. In addition, the screws 43 and the positioning holes 422 of the inside rose liner 42 are omitted. In order to provide a better positioning effect, the pull-resisting ring 46 includes a plurality of annularly spaced depressions 462 on a side thereof that faces the inside rose liner 42. The inside rose liner 42 includes two diametrically disposed protrusions 424 that may be releasably retained in two associated depressions 462 of the pull-resisting ring 46. Thus, the pull-resisting ring 46 may be retained in an angular position relative to the inside rose liner 42 during use of the door lock.

Although the invention has been explained in relation to its preferred embodiment, it is to be understood that many other possible modifications and variations can be made without departing from the spirit and scope of the invention as hereinafter claimed.

What is claimed is:

1. A door lock comprising:

a main body including a transmission assembly and a positioning assembly, the transmission assembly including an inside spindle, an outside spindle, a retractor, and a latch bolt, the positioning assembly including an inside seat and an outside seat, the outside seat including an outer threading;

an inside rose liner mounted around the inside seat;

an inside rose mounted around the inside rose liner;

an anti-torque ring mounted around the outside seat and including two lugs formed thereon, two positioning posts respectively projecting from the lugs and extending along a longitudinal direction of the anti-torque ring;

an outside rose liner including an inner threading that is engaged with the outer threading of the outside seat, the outside rose liner including a side with an annular recessed portion for receiving the anti-torque ring, the annular recessed portion including two recess extensions for positioning the lugs of the anti-torque ring, thereby preventing loosening of the outside rose liner;

an outside rose securely mounted around the outside rose liner to rotate move therewith;

an inside handle operably connected to the transmission assembly; and an outside handle operably connected to the transmission assembly;

whereby rotation of the outside rose causes longitudinal movement of the outside rose and the outside rose liner relative to the outside seat to suit a thickness of a door to which the door lock is mounted.

2. The door lock as claimed in claim 1, wherein the inside seat includes an outer threading having two diametrically disposed flat surfaces, the inside rose liner including a hole, an inner periphery that defines the hole of the inside rose liner including two diametrically disposed flat sections, the inside rose liner being mounted around the inside seat with the flat sections of the inside rose liner engaged with the flat surfaces of the inside seat.

3. The door lock as claimed in claim 1, further comprising a pull-resisting ring mounted around the inside seat, the pull-resisting ring including an inner threading engaged with the outer threading of the inside seat.

4. The door lock as claimed in claim 1, wherein the outside seat includes an outer threading having two diametrically disposed flat surfaces, the anti-torque ring including a hole, an inner periphery that defines the hole of the anti-torque ring including two diametrically disposed flat sections, the anti-torque ring being mounted around the outside seat with the flat sections of the anti-torque ring engaged with the flat surfaces of the outside seat.

5. The door lock as claimed in claim 1, wherein the inside rose liner includes two positioning holes, each said positioning post including a screw hole aligned with an associated said positioning hole, further comprising two screws each extending through the associated positioning hole and the screw hole in an associated said positioning post.

6. The door lock as claimed in claim 3, wherein the inside rose liner includes two diametrically disposed protrusions, and wherein the pull-resisting ring includes a plurality of annularly spaced depressions for releasably receiving the protrusions, thereby retaining the pull-resisting ring.

* * * * *